US007097034B2

(12) United States Patent
Woog

(10) Patent No.: US 7,097,034 B2
(45) Date of Patent: Aug. 29, 2006

(54) CARRIER

(76) Inventor: Gunter Woog, 5435 Bauers Dr., West Bend, WI (US) 53095

( * ) Notice: Subject to any disclaimer, the term of this patent is extended or adjusted under 35 U.S.C. 154(b) by 24 days.

(21) Appl. No.: 10/365,862

(22) Filed: Feb. 13, 2003

(65) Prior Publication Data

US 2003/0213263 A1 Nov. 20, 2003

Related U.S. Application Data

(63) Continuation-in-part of application No. 10/150,525, filed on May 17, 2002, now Pat. No. 6,802,802.

(51) Int. Cl.
*B65D 75/00* (2006.01)

(52) U.S. Cl. ..... 206/427; 206/162; 206/147

(58) Field of Classification Search ..... 206/147, 206/162, 170, 175, 188, 194, 199; 62/371, 62/372, 373, 457.5, 457.4; 229/457.4, 101
See application file for complete search history.

(56) References Cited

U.S. PATENT DOCUMENTS 2,860,816 A 11/1958 Fielding
2,979,227 A * 4/1961 Taber et al. ..... 206/169
3,605,435 A 9/1971 Taylor
3,677,458 A * 7/1972 Gosling ..... 229/120.011
4,096,985 A * 6/1978 Wood ..... 206/427
4,238,069 A 12/1980 Morris, Jr.
4,531,381 A 7/1985 Toro et al.
4,836,367 A * 6/1989 Golkar ..... 206/200
4,858,444 A 8/1989 Scott
4,899,553 A 2/1990 Drummond, III
5,040,672 A * 8/1991 DeMaio et al. ..... 206/162
5,094,359 A * 3/1992 DeMars et al. ..... 229/101
5,170,934 A * 12/1992 Lemoine ..... 229/101
5,423,478 A 6/1995 Roosa
5,495,727 A * 3/1996 Strong et al. ..... 62/529
5,558,224 A 9/1996 Fogle
5,857,570 A * 1/1999 Brown ..... 206/427
5,957,276 A * 9/1999 Cutler et al. ..... 206/194
6,058,733 A 5/2000 Morgan
6,065,303 A 5/2000 Harris
6,164,526 A 12/2000 Dalvey
6,802,802 B1 * 10/2004 Woog ..... 493/129

* cited by examiner

*Primary Examiner*—David T. Fidei
(74) *Attorney, Agent, or Firm*—Philip M. Weiss; Weiss & Weiss

(57) ABSTRACT

A carrier for cans, bottles, containers, or stackable items. In particular, the carrier can also cool or heat the cans, bottles, or other containers.

3 Claims, 7 Drawing Sheets

Fig. 3
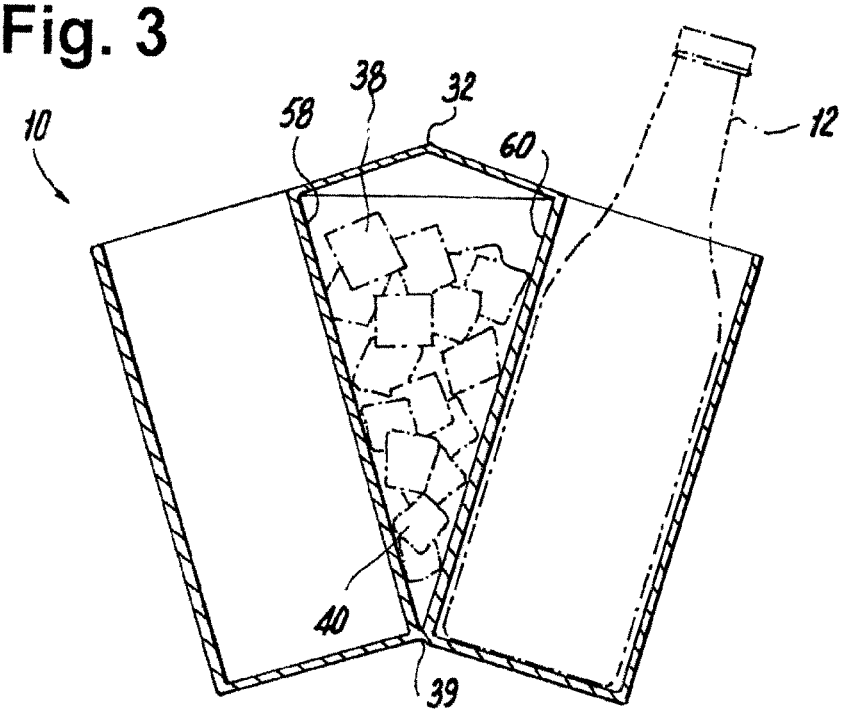
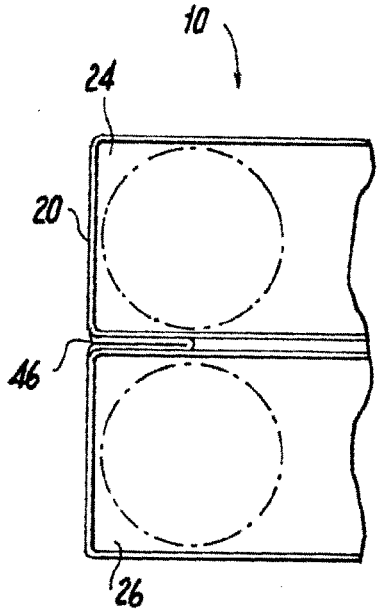
Fig. 4A
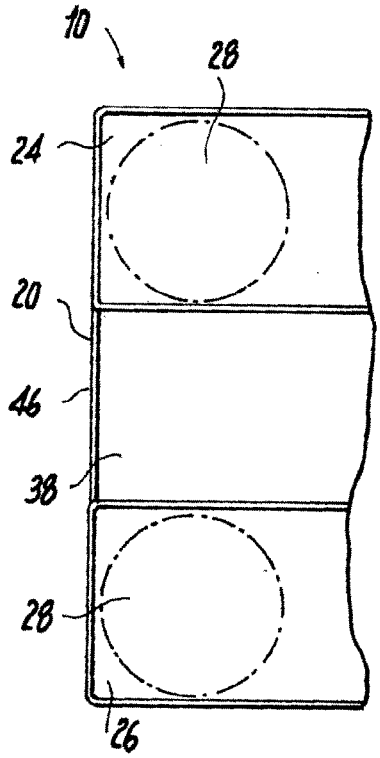
Fig. 4B

CARRIER

RELATED APPLICATIONS

This is a continuation in part of Ser. No. 10/150,525 filed May 17, 2002 now U.S. Pat. No. 6,802,802.

FIELD OF THE INVENTION

The present invention relates to a carrier for cans, bottles, containers, or stackable items. In particular, the carrier can also cool or heat the cans, bottles, or other containers.

BACKGROUND OF THE INVENTION

Collapsible paperboard carriers for beverages contained in cans or bottles are commonplace in the industry. Examples of various such carriers are shown in U.S. Pat. Nos. 2,860,816 and 5,040,672. Such carriers are examples of one of the many types of commercially used packaging used in transportation and sale of canned and bottled beverages.

U.S. Pat. No. 6,360,558 describes an adaptation of a common beverage package that enables the same to perform a dual function wherein it also serves as an ice-containing cooler for the beverage containers.

U.S. Pat. No. 5,558,224 relates to a triangular carrier comprised of a top panel and converging end panels connected to triangular side panels. The carrier holds a plurality of rows of articles, each article extending between the side panels, with each row containing a greater number of articles then the next lower row. Openings at the corners of the carrier allow portions of adjacent articles to protrude.

U.S. Pat. No. 4,819,793 relates to a beverage carrier. One embodiment includes flexible water resistant container having a flexible container with a bottom and upstanding walls and a top opening. The container further includes a removable flooring for supporting beverages in the container, nesting in the container adjacent the bottom. A separator is provided for spacing apart beverages in the container from one another. A further embodiment provides like structure with the flooring having a coolant for cooling the beverages.

U.S. Pat. No. 5,743,389 relates to a reversible food and beverage carrier. A flat paper stock blank is disposed for assembly into a dual configuration food and beverage carrier, selectively folded into an upright box with upward extending side walls and end walls with handle panels extending from the box base around the side walls and meeting over the box as a handle or alternatively into an inverted box with downwardly extending side and end walls with handle panels extending from the base upward and away from the side walls. When the handle panels are folded toward and around the base side walls, the carrier is disposed to enclose foodstuffs placed in the carrier. When the handle panels are folded away from the base side walls, the carrier becomes a cup and cone carrier, the box being carried inverted. One or more holes are provided in the base section for receiving cups and cones. Hinged sections are provided at the hole perimeter to cover the hole, lightly connected until mildly urged downward to receive a cup thereby breaking the light connection.

U.S. Pat. No. 5,404,672 relates to a basket style article carrier which includes a bottom wall, a pair of side walls foldably joined to opposite side edges of the bottom wall, end panels foldably joined to each end of the side wall, a riser panel foldably joined to the inner edge of the end panels foldably at one end of the carrier, a pair of medial panels foldably joined respectively to the inner edges of the end panels at the other end of the carrier, a pair of handle panels foldably joined respectively to the medial panels and secured in flat face contacting relation with the medial panels, cross partition structure foldably joined to each medial panel and a longitudinal reinforcing beam panel foldably joined along its top edge to the bottom edge of one medial panel and secured at one end to one of the medial panels and at the other end to one of the riser panels.

U.S. Pat. No. 4,899,553 relates to a cooling device for beverage containers. Cooling arrangements are provided for cooling beverage containers of a multi-container package. In one embodiment, a cooling device consists solely of a shaped, generally planar slab of ice including a surface for directly engaging and supporting the bottoms of the beverage containers of the package. This surface includes a plurality of recesses therein in which the bottoms of the beverage containers are received.

U.S. Pat. No. 4,858,444 relates to a portable cooler for carrying and cooling a 15 pack of beverages including a sealable cavity for pyramid stacked containment of 12 or 16 oz. canned beverages, a plastic insert for retaining the lower layers of cans in side-by-side relation and supporting stacking of subsequent layers of cans upward, and dual storage spaces for ice about said beverage cans. The exterior of the portable cooler further includes such features as a flap with a velcro fastener for closing said sealable cavity, multiple pockets for paraphernalia, and carrying strap.

U.S. Pat. No. 4,531,381 relates to a cooling assembly to maintain a bottle of wine or like beverage at a chilled temperature and in a predetermined orientation to facilitate serving. A housing includes a cooling compartment removably secured therein in surrounded relation to insulating material wherein the cooling compartment may be at least partially filled with water and separately subjected to a freezing environment for freezing the water and forming ice to be used as a coolant. A closure and a cover structure is mounted on the cooling compartment to provide access to a coolant chamber while at the same time serving to separate the interior of the cooling compartment from ambient temperature surrounding the housing.

U.S. Pat. No. 4,238,069 relates to a one piece corrugated container. The container is formed of a unitary blank of foldable paperboard which has a bottom panel generally rectangular in outline which is integrally connected to opposed end walls and side walls to provide an upwardly facing opening. Corner gussets between each end wall and the adjacent side wall are folded inwardly alongside the adjacent side wall with the free extremities of the gussets adjacent each end wall carrying upstanding projections which overlap each other. An end flap on each end wall is folded inwardly along the inner surface of the adjacent gussets and has a slot along its fold line for receiving the adjacent upstanding projections.

U.S. Pat. No. 5,957,276 relates to a paperboard blank storable in a flat condition ready for folding into a dual configuration food and beverage carrier, selectively folded into an upright box with upward extending handle panels and end walls with the handle panels extending from a box base around side walls and meeting over the box as a handle or alternatively into an inverted box with downwardly extending side and end walls with handle panels extending from the base upward and away from the side walls. When the handle panels are folded towards and around the base side walls, the carrier is disposed to enclose food stuffs placed in the carrier and simultaneously capable of carrying one or two cups placed through appropriately sized openings in the base.

U.S. Pat. No. 4,955,516 relates to a portable beverage carrier adapted for mounting on a horizontal top frame tube of a bicycle which includes a pair of insulated receptacles, each dimensioned to receive one or a plurality of standard beverage containers. The insulated receptacles each include a zipper fastened cover. The covers and receptacles are each formed from a fabric material lined with a gel refrigerant encapsulated within a water proof liner.

U.S. Pat. No. 5,050,399 relates to an apparatus for use particularly within an automotive environment, including a central support container for securement of a plurality of chambers therewithin, wherein each chamber provides reception of a predetermined quantity of a refrigerant gel or fluid. The support container includes a U shaped support base, including a plurality of upstanding extending arcuate legs for surmounting a transmission tunnel housing of an associated automobile. In one embodiment, the support container includes an elongate cavity to complementarily receive a plurality of insert holder chambers, wherein each chamber includes an insert cavity, each cavity containing a deformable refrigerant chamber. Each refrigerant chamber includes a through extending cylindrical bore to receive a beverage container therewithin.

U.S. Pat. No. 5,901,571 relates to a portable beverage carrier for transporting beverages while keeping them at a constant temperature for long periods of time. The device includes a case and a cooler insert member. The case functions as a suitcase and includes a base, a top hingedly secured to the base, and a latching means. The cooler insert member is disposed within a hollow interior of the case base and includes a plurality of beverage container receiving cavities. The cooler insert member is collapsible for convenient storage.

U.S. Pat. No. 6,065,303 relates to a cold can or bottle cooler dispenser for keeping cold and compactly transporting both homemade liquid refreshment and canned or bottled refreshments in separate compartments. A rotatable cowling having an opening which surrounds the mid section of the cooler allows selection of the desired canned or bottled refreshment. Compartments are also provided for reusable substitute ice packs.

U.S. Pat. No. 6,164,526 relates to a disposable and recyclable cooler made of paper coated with a polymer. Some embodiments transform from a first configuration that snugly retains a set of beverage containers to a second, expanded configuration that retains ice proximate the beverage containers.

SUMMARY OF THE INVENTION

The present invention relates to a carrier comprising: a bottom panel; a pair of side panels extending upwardly from opposite ends of the bottom panel; a pair of end panels extending upwardly from the bottom panel and having opposite side edges joined to side edges of respective side panels. A pair of top panels are connected to an upper periphery of one of the side panels. A plurality of openings are located in each of the top panels. The top panels are connected at their ends to the end panels and connected on their sides to the upper edges of the side panels and to the end panels. The top panels are proximally located to an opening for access to a central interior cavity of the carrier. The central interior cavity is defined by a pair of lateral internal panels. It is an object of the present invention for the carrier to open up to create the central interior cavity. It is an object of the present invention for the carrier to comprise a carrying handle. It is an object of the present invention for the central interior cavity of the carrier to have a waterproof protective inner lining.

The present invention relates to a carrier comprising: a flexible container having a bottom and upstanding side walls and means for cooling bottles, cans and other containers placed in the container. The cooling means are located in the center of the container. Separator means are used for spacing apart cans or bottles in the container from one another. It is an object of the present invention for the container to be made from water resistant material.

It is an object of the present invention for the carrier to comprise a handle. It is an object of the present invention for the container to have reinforced side walls. It is an object of the present invention for the container's walls to be double walled to promote insulation.

The present invention relates to a carrier for bottles, cans or other containers. It is an object of the present invention for the carrier to hold cookies, crackers, casino chips, coins and other stackable items. It is an object of the present invention for the carrier to serve as a cooler for cooling bottles, cans or other containers. It is an object of the present invention for the carrier to be either disposable either after a single use or, optionally, after multiple uses.

It is an object of the present invention for the carrier to be made of paperboard or plastic. It is an object of the present invention for the carrier to me made of a moldable material.

The present invention relates to a carrier made of molded plastic. The carrier has an internal cavity, a top, bottom and side walls and an equal number of holes or openings on either side of the internal cavity. It is an object of the invention for the holes or openings to be able to receive bottles, cans or other containers. It is an object of the present invention for the holes or openings to be able to receive cookies, crackers, casino chips, coins or other stackable items. It is an object of the invention for a cover to be placed on the openings once the cans, bottles or other containers are placed in the openings. It is an object of the present invention for the covers to be clear so that a user can see the contents of what is in the openings. It is an object of the present invention for the openings to be adjustable or for an insert to be placed in the openings to allow different size bottles, cans, containers, and other items to be placed in the openings. It is an object of the present invention for a handle to be attached to the molded carrier. It is an object of the present invention for the carrier to be made of styrofoam. It is an object of the invention for the carrier to be made of an injection molded material.

It is an object of the present invention for the bottles, cans and containers to include: beverage cans and bottles, vitamins and supplements, upside down plastic bottles with piston appearing bottles, automotive additives and oils. Smaller versions of the carrier can be used for photographic films and batteries.

It is an object of the present invention to provide graphics on the outside of the carrier.

It is an object of the present invention for the amount of openings to consist of an even number of openings, such as 2, 4, 6, 8, 10 and 12.

It is an object for the carriers that are made of styrofoam or injection molded plastic to have wheels attached to the bottom or side of the carrier to help transport the carrier. It is an object of the present invention for the carrier to fit into a device which has wheels for transporting the carrier.

It is an object of the injection molded plastic carrier to have a temperature controlled insert which can be placed in the center of the carrier for heating or cooling the cans, bottles, or containers.

It is an object of the present invention for the carrier to be made of metal and function as a barbecue. It is an object for the barbecue to have side openings for storing condiments. It is an object for the carrier to be able to store meats or charcoal inside the carrier.

The present invention further relates to a container in the shape of an engine comprising: openings for placing individual bottles, cans, containers or other items and a central opening for placing cooling devices for cooling the bottles, cans, or containers. It is an object of the invention for the container to further comprise a handle. It is an object of the invention for the container to further comprise wheels.

The invention will be further set forth in the detailed description, accompanying claims and in the drawings.

BRIEF DESCRIPTION OF THE DRAWINGS

FIG. 3 is a cross-sectional view of the invention of FIG. 2, taken along line 3—3 thereof showing ice in place in the resultant cavity;

FIG. 4A is a fragmentary top view of an end of the device in the closed position showing a folded end panel;

FIG. 4B is a fragmentary top plan view, showing the device in the open position and an unfolded, flattened end panel;

DETAILED DESCRIPTION OF THE INVENTION

In an embodiment of the present invention, is provided a carrier for containers. The carrier is formed of a sheet material such as plastic or paperboard. The carrier includes a bottom panel attached on opposite lateral sides to side panels, a pair of opposed end panels connected at their lower peripheries to the bottom and side panels, and a central handle which is formed of two halves folded together in a first position for ease in carrying and for economy of display space for retail sale display. The handle is pivotal to an open position along its top fold line, allowing the carrier to spread outwardly to form a central interior cavity capable of holding cooling devices, such as cooling gels, frozen plastic bars and ice for the purpose of cooling the containers.

In a preferred embodiment, each end panel is also provided with pleated panels that enable the outwardly opened carrier to be capable of providing a tray that holds ice and resultant water after melting of the ice. The pleated panels are integrally connected to a flat, rectangular panel of the end panels, which in turn is connected to the peripheries of the side panels. The carrier has a pair of top panels that are provided with a plurality of openings, for example, six or eight, each of which is adapted to receive a container.

In a further embodiment, the openings can hold other objects, such as cookies, crackers, casino chips, coins and other stackable items.

While eight openings are used in a preferred embodiment, other configurations having four, six or even twelve openings can be used. Alternatively, the carrier may be provided with two larger storage spaces, rather than separate openings. The top panels are preferably connected to the handle along their internal lateral edges, and are also integrally connected at opposite sides to the upper edges of the side panels. In an embodiment, the interior of the carrier is provided with waterproof protective inner coating or a lining which may be a flexible plastic sheet material such as polyethylene or propylene or a wax like substance.

The invention may be equipped with a microchip that relays an audio display when the invention is moved from a closed to an open position.

The invention further relates to a method for forming the carriers in either paperboard or plastic form.

Figure 1:
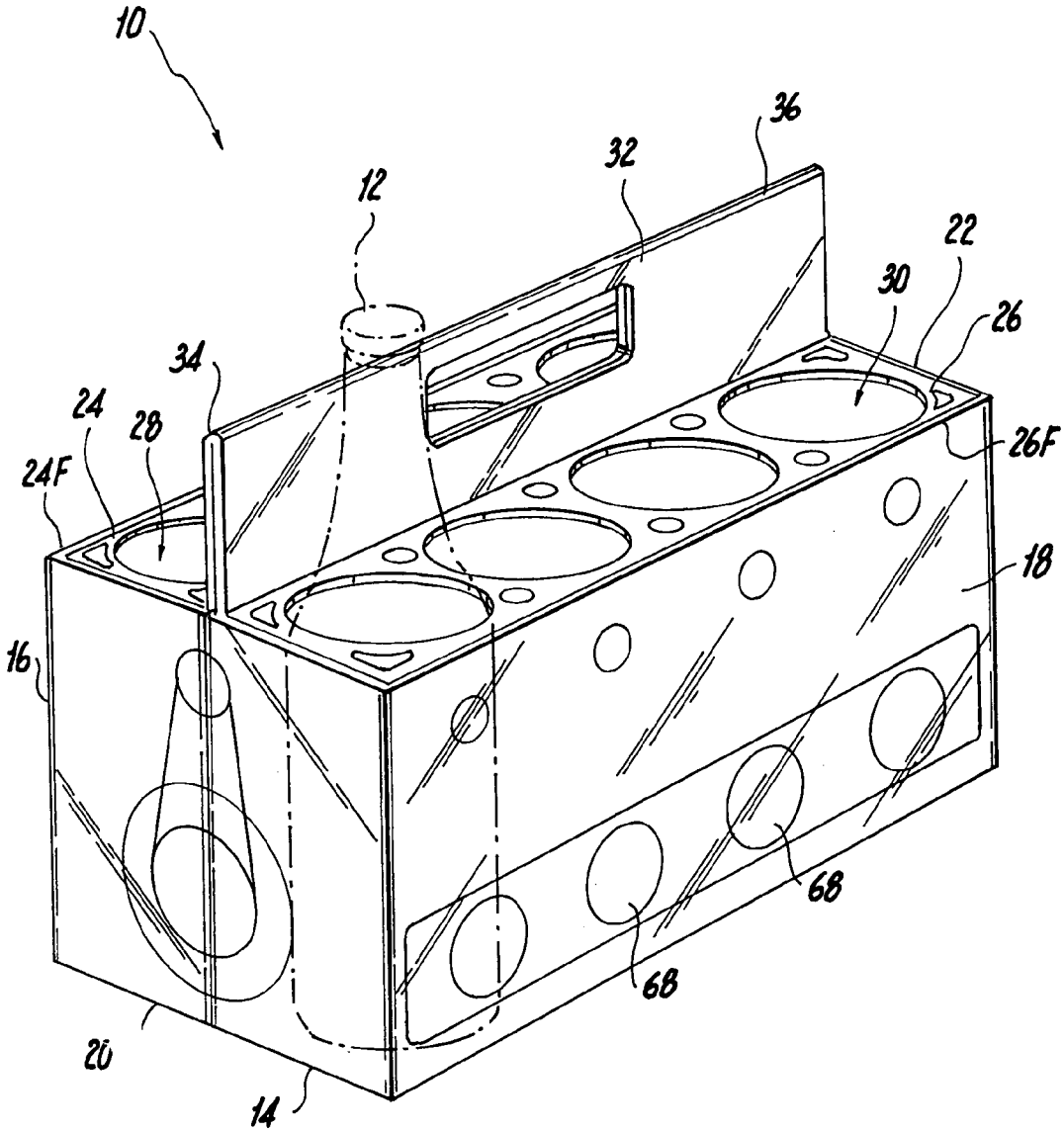
FIG. 1 is a perspective view illustrating a carrier/cooler of the present invention in conjunction with bottled goods.
Figure 2:
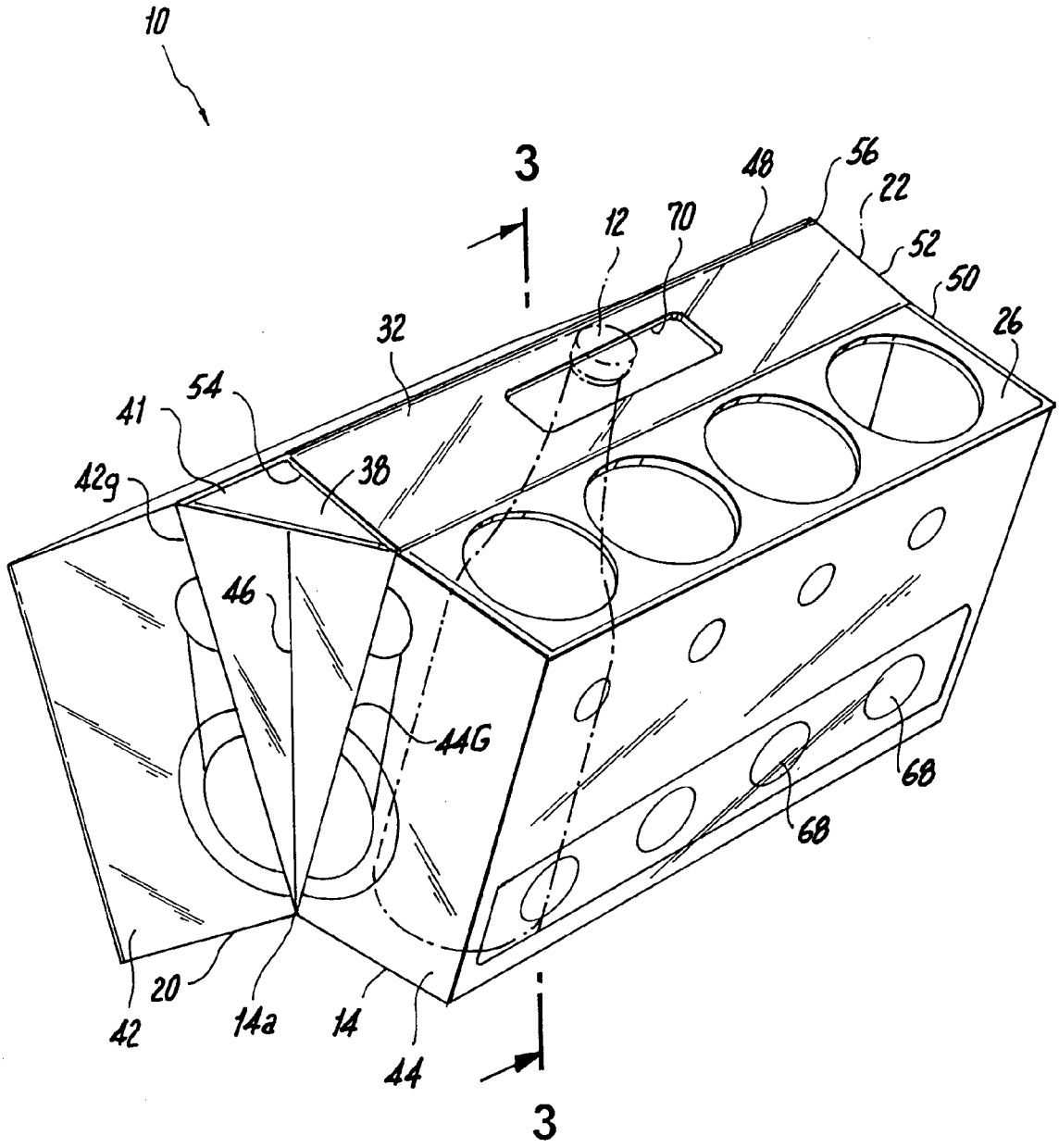
FIG. 2 is a perspective view of the embodiment shown in FIG. 1, but showing the device in the open position.

FIGS. 1 and 2 show a carrier device 10 of the present invention. In the illustrated embodiment, carrier 10 is designed to contain eight individual containers, which in the illustrated embodiment are conventional bottles 12.

Referring to FIG. 1, carrier 10 is formed from a sheet material such as paperboard or, alternatively, of a plastic material, such as polyethylene, polypropylene, or any other similar type substance. Carrier 10 is defined by a bottom panel 14, which has a pair of side panels 16 and 18 attached on each lateral side and extending upwardly from said bottom panel 14. The side panels 16 and 18 are also connected to a pair of opposed end panels 20 and 22. The upper edges 24F and 26F of the side panels 16 and 18, respectively, are integrally connected to a pair of top panels 24 and 26, respectively. A plurality of openings 28 and 30 are provided in the top panels 24 and 26, respectively for access to and display of the containers 12. The top panels 24 and 26 are also integrally connected at their opposed edges to the end panels 20 and 22. The upper edges of the side panels 16 and 18, as well as the end panels 20 and 22, are all integrally connected to the top panels 24 and 26. The top panels 24 and 26 are integrally connected along their internal lateral sides to a central handle 32. The handle 32 is formed of two folded halves of material, 34 and 36.

Referring to FIG. 2, the end panels 20 and 22 each are made up of three panels, 42, 44 and 46, and 48, 50, and 52, respectively. The panels 42 and 44 of the end panel 20 are flat, quadrilateral panels. The internal longitudinal edges 42G and 44G of the panels 42 and 44 connect to the edges of the internal panel 46, which is triangular in shape and pleated inwardly along a central axis 54. The panels 48, 50 and 52 of the end panel 22 are connected in a similar fashion as the panels of the end panel 20, with the central panel 52 being triangular in shape and also pleated along a central axis 56.

The handle 32 is pivotally moved outward to form an enlarged cavity 38, with through opening 41. Access through the opening 41 enables filling of the cavity 38 of the carrier with a frozen material such as, ice cubes (See FIG. 3), as desired. The inverted pyramidal cavity 38 is defined by the unfolded central side panels 46 and 52 and a pair of internal walls 58 and 60 of the carrier 10. The internal walls 58 and 60 are connected at a common foldable divider line 14*a* of the bottom panel 14. The expanded handle 32 can also act as an insulator to slow the melting process of the ice cubes 40.

The carrier 10 may be adorned with markings 68. Also, a microchip 70 may be placed within the handle 32 so that an audio display results when the handle 32 is pivotally moved outward. Alternatively, the microchip could be placed anywhere within the carrier 10 where it would be activated as the carrier 10 is moved to an open position. The microchip 70 is suitable to be used on any embodiments of the present invention. Together the markings 68 and the microchip 70 can give one the appearance of an engine block when the carrier 10 is in the open position and enhance the use and enjoyment of the carrier 10.

Referring to FIG. 3, a cross-sectional view of FIG. 2 of the carrier 10 is shown with the ice cubes 40 placed in the resultant cavity 38. The ice cubes 40 rest along the internal panels 58 and 60 of the carrier 10 to cool the container 12. The handle 32 acts as a cover for the ice 40.

Referring to FIG. 4A, a fragmentary top view of an end of the carrier 10 in the closed position is shown. The central pleated panel 46 of the end panel 20 is shown folded inwardly. When the carrier 10 is in the closed position, it is easier to transport and store the carrier 10.

Referring to FIG. 4B, a fragmentary top view of an end of the carrier 10 in an open position is shown. The central panel 46 of the end panel 20 is expanded, forming the cavity 38. The open position allows the carrier 10 to be used to cool the containers 12 (not shown) or other products, which are placed within the openings 28 and 30 of the top panels 24 and 26.

Figure 5A:
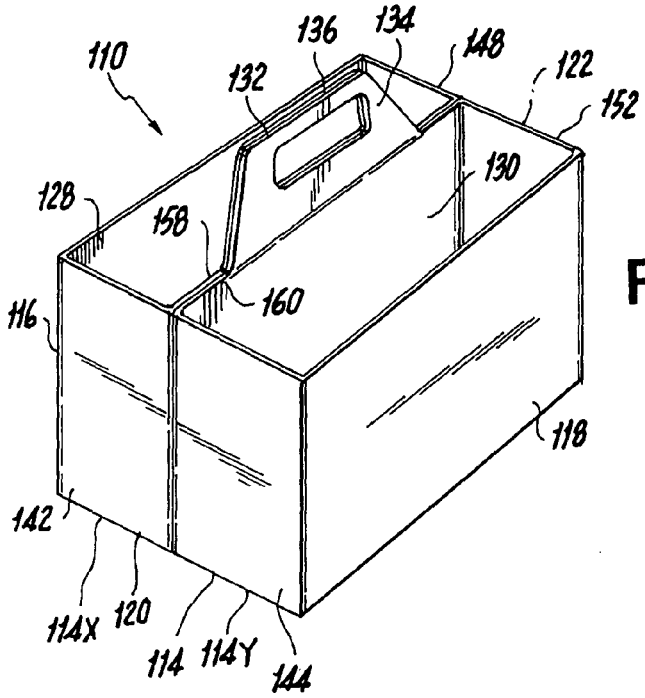
FIG. 5A is a perspective view of an alternative embodiment of the present invention.
Figure 5B:
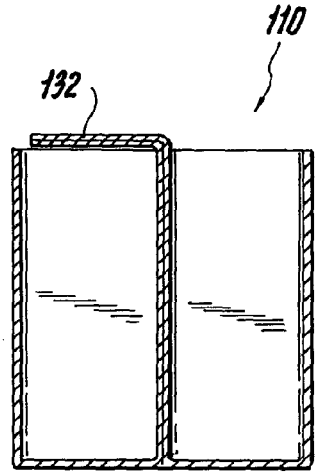
FIG. 5B is an end view of the embodiment shown in FIG. 5A.
Figure 5C:
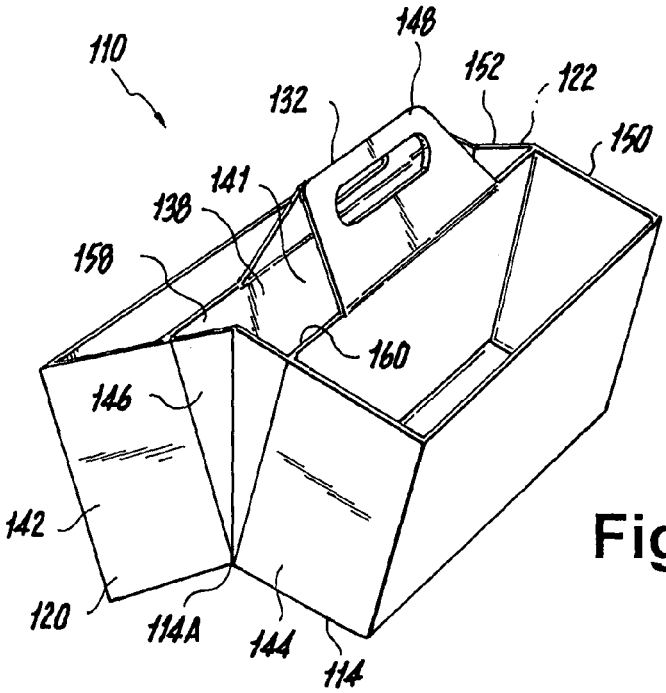
FIG. 5C is a perspective view of the embodiment shown in FIGS. 5A and 5B, in the open position.

Referring now to FIGS. 5A, 5B, and 5C, another embodiment of the invention is shown. In this embodiment, the carrier 110 is designed to carry more than just bottles and cans, but other food products or objects as well.

Referring to FIG. 5A, carrier 110 is formed from a sheet material such as paperboard or, alternatively, of a plastic material. Carrier 110 is defined by a bottom panel 114, which has side panels 116 and 118 attached on each lateral side, and extending upwardly from said bottom panel 114. The side panels 116 and 118 are also connected to a pair of opposed end panels 120 and 122. The top of the carrier 110 is open, thereby forming storage areas 128 and 130. The storage area 128 is defined by a bottom panel portion 114X of the bottom panel 114, the side panel 116, an internal panel 158 of the carrier 110, a flat quadrilateral 142 of the end panel 120 and a flat quadrilateral panel 148 of the end panel 122. The storage area 130 is defined by a bottom panel portion 114Y of the bottom panel 114, the side panel 118, an internal panel 160 of the carrier 110, a flat panel 144 of the end panel 120 and the panel 150 of the end panel 122. A handle 132 is formed of two folded halves of material, 134 and 136. The handle 132 is integrally connected along the upper edges of the internal panels 158 and 160.

Referring to FIG. 5B, a side view of carrier 110 is shown. The handle 132 is folded over to one side of the carrier 110, thereby allowing multiple containers 110 to be easily stacked and stored upon one another.

Referring to FIG. 5C, the carrier 110 of FIGS. 5A and 5B is shown in the open position. The end panels 120 and 122 each are made up of three panels, 142, 144, and 146, and 148, 150 and 152, respectively. The panels 142 and 144 of the end panel 120 are flat, rectangular panels. The internal longitudinal edges of the panels 142 and 144 connect to the edges of the internal panel 146, which is triangular in shape and pleated inwardly along a central axis 154. The panels 148, 150 and 152 of the end panel 122 are connected in a similar fashion as the panels of the end panel 120, with the central panel 152 being triangular in shape and pleated inwardly along a central axis 156.

Referring to FIG. 5C, handle 132 is pivotally moved outward to form an enlarged cavity 138, with access through opening 141. Access through opening 141 enables filling of the cavity 138 of the carrier 110 with frozen material, such as ice cubes 40 (not shown), as desired. The inverted pyramidal cavity 138 is defined by the unfolded central end panels 146 and 152 and internal panels 158 and 160 of the carrier 110. The internal walls 158 and 160 are connected at a common foldable divider line 114A of the bottom panel 114. The expanded handle 132 can also act as an insulator to slow the melting process of the frozen material, such as ice cubes 40 (not shown).

Figure 6A:
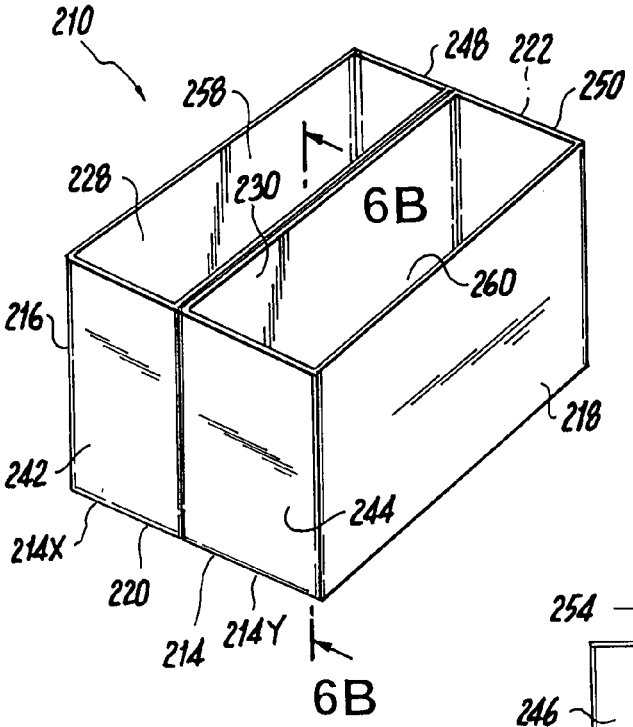
FIG. 6A is a perspective view of another alternative embodiment illustrating a loop type handle.
Figure 6B:
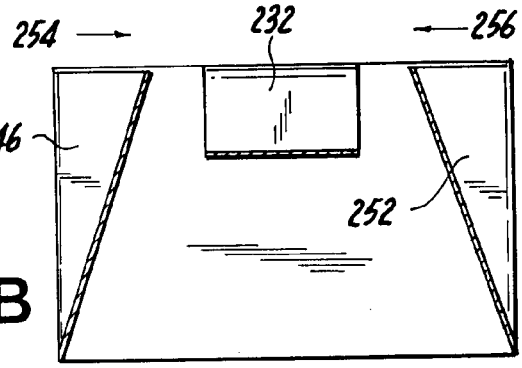
FIG. 6B is a cutaway view of the device shown in FIG. 6A as seen from the central axis of the device.
Figure 6C:
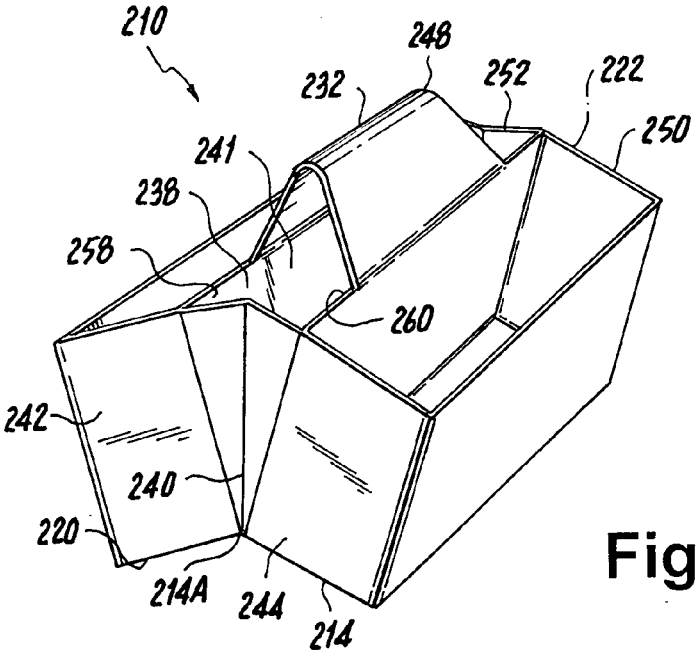
FIG. 6C is a perspective view of the device shown in FIGS. 6A and 6B, illustrating the open position.

Another embodiment of the invention is shown in FIGS. 6A, 6B and 6C. In this embodiment, a carrier 210 is designed with a handle 232 (FIGS. 6B and 6C) that may be folded inside of the carrier 210 for easier stacking of multiple carriers.

Referring to FIG. 6A, carrier 210 is formed from a sheet material such as paperboard, or alternatively, of a plastic material. The carrier 210 is defined by a bottom panel 214, which has side panels 216 and 218 attached on each lateral side and extending upwardly from said bottom panel 214. The side panels 216 and 218 are also connected to opposed end panels 220 and 222. The top of the carrier 210 is open, thereby forming storage areas 228 and 230. The storage area 228 is formed by a bottom panel portion 214X of the bottom panel 214, the side panel 216, an internal panel 258 of the carrier 210, a flat panel 242 of the side panel 220 and a flat panel 248 of the side panel 222. The storage area 230 is formed by a bottom panel portion 214Y of the bottom panel 214, the side panel 218, an internal panel 260 of the carrier 210, a flat panel 244 of the side panel 220 and a flat panel 250 of the side panel 222. The handle 232 is formed of a pliable loop of material, thereby allowing the handle to be folded inwardly of the carrier 210. The handle 232 is integrally connected along the upper edges of the internal panels 258 and 260, and is folded inwardly between the internal panels 258 and 260.

Referring to FIG. 6B, a sectional view of the carrier 210 described in FIG. 6A and taken along line 6A—6A is shown. The panels 246 and 252 are shown folded inwardly along central axes 254 and 256, respectively. The handle 232 is folded inwardly of the carrier 210.

Referring to FIG. 6C, the carrier 210 of FIGS. 6A and 6B is shown in an open position. The end panels 220 and 222 each are made up of three panels, 242, 244, and 246, and 248, 250 and 252, respectively. The panels 242 and 244 of the end panel 220 are flat, quadrilateral panels. The internal longitudinal edges of the panels 242 and 244 connect to the edges of the internal panel 246, which is triangular in shape and pleated inwardly along the central axis 254 (See FIG. 6B). The panels 248, 250, and 252 of the end panel 222 are connected in a similar fashion as the panels of the end panel 220, with the central panel 252 being triangular in shape and pleated along the central axis 256 (See FIG. 6B).

Referring to FIG. 6C, handle 232 is pivotally moved outward to form an enlarged cavity 238, with access through opening 241. Access through opening 241 enables filling of the cavity 238 of the carrier 210 with frozen material, such as ice cubes 40 (not shown), as desired. The pyramidal cavity 238 is defined by the unfolded central end panels 246 and 252 and internal walls 258 and 260 of the carrier 210. The internal walls 258 and 260 are connected at a common foldable divider line 214A of the bottom panel 214. The expanded handle 232 is made of flexible material.

Figure 7:
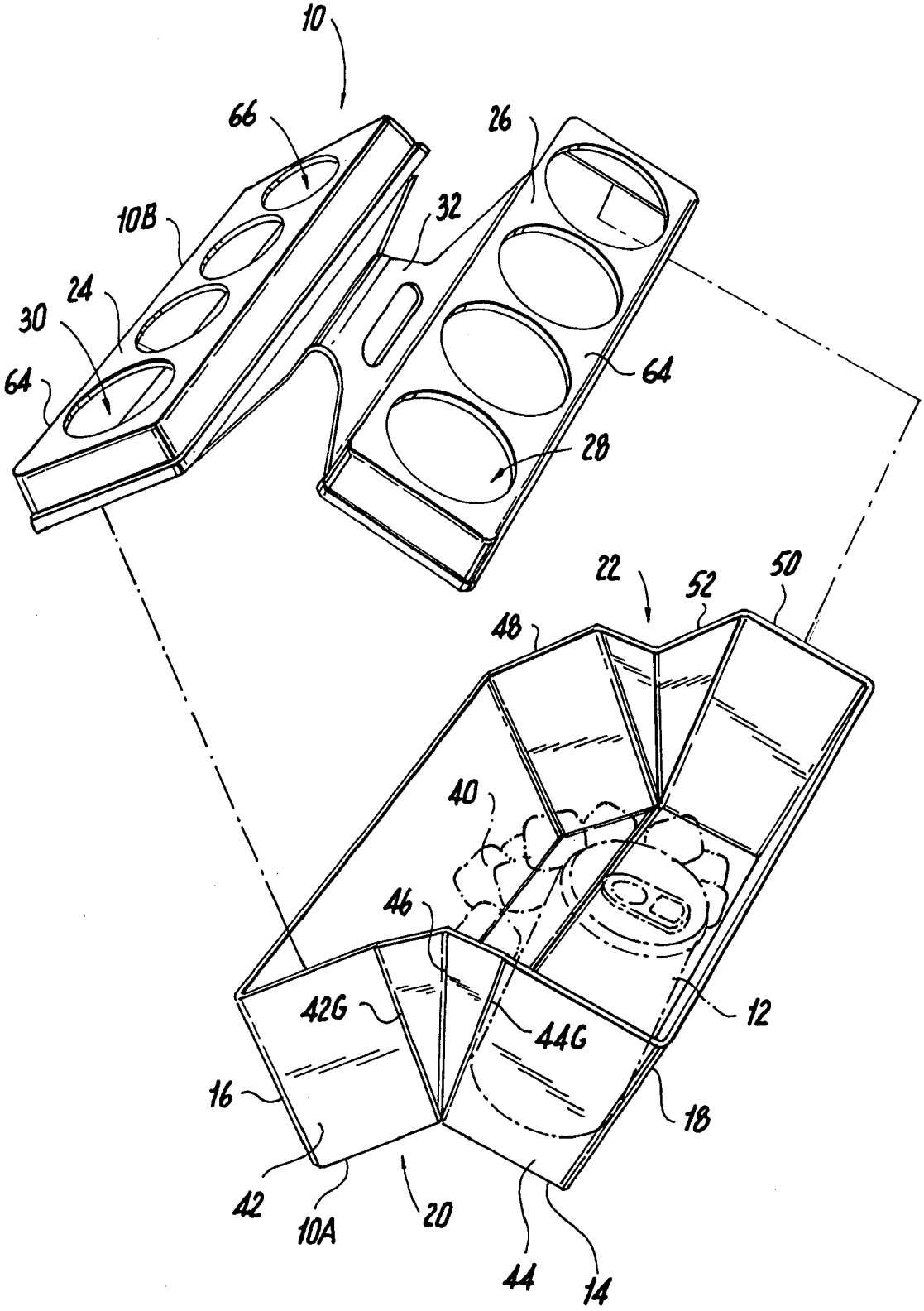
FIG. 7 is an exploded view of an embodiment of the present invention, where the invention is made with vacuum formed plastic parts.

FIG. 7 is an exploded view of the present invention, made with plastic material. The carrier 10 is designed from two vacuum formed parts, 10A and 10B. Formed part 10A comprises the bottom panel 14, the side panels 16 and 18, and the end panels 20 and 22. The end panel 20 is made up of three panels, the flat panels 42 and 44, and the triangular shaped pleated panel 46. The panels 42 and 44 are integrally connected to the pleated panel 46 along the edges 42G and 44G, respectively. The end panel 22 is made up of three panels, 48, 50 and 52, in the same fashion as the end panel 20.

The formed part 10B comprises a cover and includes the handle 32 and the top panels 24 and 26. The top panels 24 and 26 contain the plurality of openings 28 and 30, respectively. The formed part 10B is welded electronically onto the formed part 10A. The carrier 10 made as shown in FIG. 7 preferably does not include the internal panels 58 and 60 (See FIG. 3). The ice cubes 40 are allowed to fall around the container 12. The carrier 10, when formed, should allow the top of the container 12 to be visible when the container 12 is placed within the carrier 10 through the openings 28 or 30.

Figure 8:
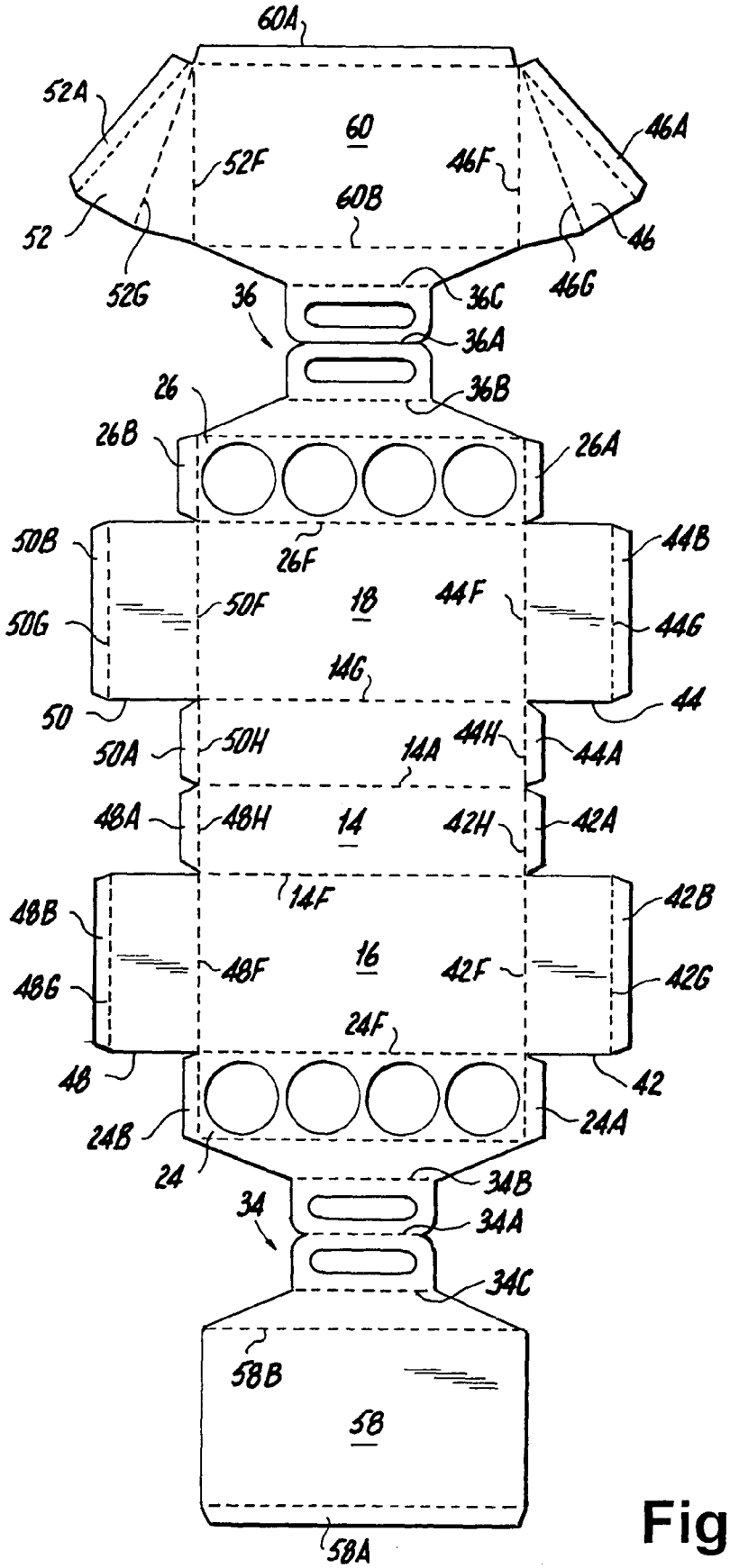
FIG. 8 is a plan view of one example of a template to be used in the manufacture of the present invention.

FIG. 8 shows a plan view of a blank template 11, which may be used in the manufacture of the carrier 10 of the present invention. One method of forming the carrier 10 includes folding the blank 11 upwardly along the fold lines 14F and 14G, leaving the blank 11 perpendicular to the bottom panel 14. Next, the flat panels 42, 44, 48 and 50 are folded inwardly along the fold lines 42F, 44F, 48F and 50F, respectively, so that the panels 42, 44, 48 and 50 are perpendicular to the blank 11 and also to the bottom panel 14.

Tabs 42A, 44A, 48A and 50A are then folded along the lines 42H, 44H, 48H and 50H, respectively, so that the tabs 42A, 44A, 48A and 50A are perpendicular to the base 14 and also parallel to the panels 42, 44, 48 and 50. Then the tabs 42A, 44A, 48A and 50A are fixedly secured to the panels 42, 44, 48 and 50, respectively, known in a manner such as with a water-resistant glue. Tabs 42B, 44B, 48B and 50B are then folded inwardly along the fold lines 42G, 44G, 48G and 50G, respectively, so that the tabs 42B, 44B, 48B, and 50B are perpendicular to the bottom panel 14. The tabs 42B, 44B, 48B and 50B are aligned along a central axis 14A of the bottom panel 14.

Next, the panels 46 and 52 are folded inwardly along the fold lines 46F and 52F so that the panels 46 and 52 are flush with the inner panel 60. The panels 46 and 52 are then folded in half along fold lines 46G and 52G so that both halves of 46 and 52 are flush with the panel 60. Tabs 46A and 52A are folded inwardly so that they are flush with the panels 46 and 52, and also, flush with the panel 60.

The handle halves 34 and 36 are folded inwardly towards the center of the carrier 10 along the lines 34A and 36A and the folded over handles are fixedly secured to themselves. That is, the half 34 is secured to the folded over portion of 34, and the half 36 is secured to the folded over portion of 36. The inner panels 58 and 60 are folded outwardly along fold lines 58B and 60B, leaving the panels approximately perpendicular to the folded handle halves 34 and 36. Tabs 58A and 60A are folded inwardly so that they are perpendicular to the panels 58 and 60.

The top panels 24 and 26 are folded inwardly so that they are perpendicular to the side panels 16 and 18. Tabs 24A, 24B, 26A and 26B are folded inwardly so that they are perpendicular to the top panels 24 and 26. The tabs 24A, 24B, 26A and 26B are then fixedly secured to the panels 42, 48, 44 and 50, respectively.

The tabs 58A and 60A are then fixedly secured to the bottom panel 14 approximately near the axis 14A. The tabs 46A and 52A are fixedly secured to the flat panels 42 and 48 approximately along the fold lines 42G and 48G, respectively.

The handle halves 34 and 36 are then folded inwardly along lines 34B and 34C, and 36B and 36C, respectively, towards the central axis 14A, thus forming the cavity 38 (not shown).

While a method of folding and forming the carrier 10 has been shown, it is understood that a person skilled in the art could form the carrier in a similar fashion and not change the scope of the invention. Any securing materials could be employed to seal and form the carrier 10.

It is preferred to provide the interior of carrier 10 with a protective inner lining of a flexible plastic sheet material for example polyethylene, polypropylene, etc., particularly in cases where the body of carrier 10 is formed from paperboard, which requires the benefit of a protective liner to avoid damage from melting ice. As seen in FIG. 3, the liner may be in the form of a somewhat heavier plastic tray liner 39, if desired.

If the sheet material from which the carrier 10 is itself formed of a plastic sheet material or molded plastic, the carrier will be provided with a longer life permitting reuse for the consumer.

The markings 68 may be provided, if desired, to give the carrier 10, the appearance of a mock engine block. Thus, the invention can be marketed as a novelty item to racecar enthusiasts.

It will be apparent to those skilled in the art that various modifications of the foregoing illustrative embodiment are possible. Thus, the invention also encompasses any and all embodiments within the scope of the following claims.

The invention claimed is:

1. A carrier comprising:

a bottom panel;

a pair of side panels extending upwardly from opposite ends of said bottom panel;

a pair of end panels extending upwardly from said bottom panel and having opposite side edges joined to side edges of respective side panels;

a pair of top panels connected to an upper periphery of one of said side panels;

a plurality of openings in each of said top panels;

said top panels being connected at their ends to said end panels;

said top panels connected on their sides to the upper edges of said side panels and to said end panels;

said top panels proximally located to an opening for access to a central interior cavity of the carrier;

said central interior cavity being defined by a pair of lateral internal panels.

2. The carrier of claim 1 further comprising a carrying handle.

3. The carrier of claim 1 wherein said central interior cavity is provided with waterproof protective inner lining.

* * * * *